US006522306B1

(12) United States Patent
Parrikar et al.

(10) Patent No.: US 6,522,306 B1
(45) Date of Patent: Feb. 18, 2003

(54) HYBRID HORN FOR DUAL KA-BAND COMMUNICATIONS

(75) Inventors: Rajan P. Parrikar, Mountain View, CA (US); Levent Ersoy, Cupertino, CA (US)

(73) Assignee: Space Systems/Loral, Inc., Palo Alto, CA (US)

( * ) Notice: Subject to any disclaimer, the term of this patent is extended or adjusted under 35 U.S.C. 154(b) by 0 days.

(21) Appl. No.: 10/036,347

(22) Filed: Oct. 19, 2001

(51) Int. Cl.[7] ..... H01Q 13/00
(52) U.S. Cl. ..... 343/786; 33/21 R
(58) Field of Search ..... 343/771, 786; 333/21 R, 239, 242, 251

(56) References Cited

U.S. PATENT DOCUMENTS 3,568,204 A * 3/1971 Blaisdell ..... 343/725
4,047,180 A * 9/1977 Kuo et al. ..... 333/228
4,199,764 A * 4/1980 Frosch et al. ..... 343/786
4,472,721 A * 9/1984 Morz et al. ..... 333/21 R
4,574,289 A * 3/1986 Henderson ..... 333/257
4,680,558 A * 7/1987 Ghosh et al. ..... 333/21 R
4,731,616 A * 3/1988 Fulton et al. ..... 343/781 R
4,902,988 A * 2/1990 Bruns et al. ..... 333/21 A
6,005,528 A * 12/1999 Preiss et al. ..... 333/126
6,094,175 A * 7/2000 Alessi et al. ..... 333/21 A
6,396,453 B2 * 5/2002 Amyotte et al. ..... 343/786

* cited by examiner

*Primary Examiner*—Tan Ho
(74) *Attorney, Agent, or Firm*—Perman & Green, LLP

(57) ABSTRACT

A Ka-band horn for transmitting and receiving information between a ground station and a satelitte includes three sections. The throat segment of the horn is adapted for coupling to a feed and includes circular, alternating grooves and webs that are of a widening type created by linearly increasing the width of the grooves in the direction of the horn's aperture. The throat corrugations are for matching the impedance of adjacent sections of the horn. A middle segment includes an up-angle flare section and a down-angle flare section each having dual depth corrugations that enable the horn to achieve a near-HE11 mode at the aperture of the horn. The final segment of the horn is a truncated, smooth-walled, cone.

17 Claims, 8 Drawing Sheets

| GROOVE TABLE | | | | |
|---|---|---|---|---|
| GROOVE NO. | GROOVE II | | WEB II | |
| | Ø A | WIDTH | Ø B | WIDTH |
| 1 | 2.543 | .124 | 2.242 | .027 |
| 2 | 2.523 | .124 | 2.241 | .025 |
| 3 | 2.512 | .124 | 2.220 | .025 |
| 4 | 2.493 | .124 | 2.199 | .025 |
| 5 | 2.473 | .124 | 2.178 | .025 |
| 6 | 2.462 | .124 | 2.158 | .025 |
| 7 | 2.439 | .124 | 2.131 | .025 |
| 8 | 2.428 | .124 | 2.116 | .025 |
| 9 | 2.402 | .124 | 2.093 | .025 |
| 10 | 2.395 | .124 | 2.074 | .025 |
| 11 | 2.365 | .124 | 2.053 | .025 |
| 12 | 2.361 | .124 | 2.032 | .025 |
| 13 | 2.328 | .124 | 2.011 | .025 |
| 14 | 2.328 | .124 | 1.996 | .025 |
| 15 | 2.291 | .124 | 1.963 | .025 |
| 16 | 2.291 | .124 | 1.948 | .025 |
| 17 | 2.254 | .124 | 1.921 | .025 |
| 18 | 2.233 | .096 | 1.906 | .050 |
| 19 | 2.130 | .096 | 1.841 | .050 |
| 20 | 2.115 | .091 | 1.716 | .050 |
| 21 | 2.039 | .088 | 1.711 | .050 |
| 22 | 1.974 | .084 | 1.646 | .050 |
| 23 | 1.904 | .083 | 1.581 | .050 |
| 24 | 1.841 | .081 | 1.515 | .050 |
| 25 | 1.714 | .078 | 1.430 | .050 |
| 26 | 1.714 | .055 | 1.345 | .050 |
| 27 | 1.615 | .053 | 1.320 | .050 |
| 28 | 1.583 | .050 | 1.255 | .050 |
| 29 | 1.518 | .061 | 1.189 | .050 |

FIG.4a

| GROOVE TABLE | | | | |
|---|---|---|---|---|
| GROOVE NO. | GROOVE II | | WEB II | |
| | Ø A | WIDTH | Ø B | WIDTH |
| 30 | 1.453 | .153 | 124 | 090 |
| 31 | 1.388 | .152 | 039 | 090 |
| 32 | 1.322 | .159 | 191 | 090 |
| 33 | 1.257 | .057 | 129 | 090 |
| 34 | 1.197 | .054 | 864 | 090 |
| 35 | 1.121 | .052 | 198 | 090 |
| 36 | 1.062 | .049 | 133 | 090 |
| 37 | .997 | .046 | 668 | 090 |
| 38 | .931 | .044 | 501 | 090 |
| 39 | .866 | .041 | 338 | 090 |
| 40 | .866 | .093 | 412 | 090 |
| 41 | .864 | .061 | 412 | 090 |
| 42 | .864 | .062 | 412 | 090 |
| 43 | .856 | .076 | 412 | 090 |
| 44 | .856 | .076 | 412 | 090 |
| 45 | .856 | .064 | 412 | 090 |
| 46 | .856 | .058 | 412 | 090 |
| 47 | .856 | .053 | 412 | 090 |
| 48 | .856 | .047 | 412 | 090 |
| 49 | .856 | .041 | 412 | 090 |

FIG.4b

| | FREQUENCY (GHz) | HYBRID HORN (PATENT) GAIN (dB) | CORRUGATED HORN GAIN (dB) | DELTA INCREASE IN GAIN (dB) |
|---|---|---|---|---|
| TRANSMIT BAND | 19.7 | 20.30 | 20.00 | 0.30 |
| | 19.8 | 20.35 | 20.06 | 0.29 |
| | 19.9 | 20.40 | 20.11 | 0.29 |
| | 20.0 | 20.48 | 20.17 | 0.31 |
| | 20.1 | 20.56 | 20.23 | 0.33 |
| | 20.2 | 20.65 | 20.31 | 0.34 |
| | | | | |
| RECEIVE BAND | 28.3 | 23.96 | 23.58 | 0.38 |
| | 28.4 | 24.01 | 23.62 | 0.38 |
| | 28.5 | 24.05 | 23.66 | 0.39 |
| | 28.6 | 24.10 | 23.70 | 0.40 |
| | | | | |

FIG.7

HYBRID HORN FOR DUAL KA-BAND COMMUNICATIONS

BACKGROUND OF THE INVENTION

1. Field of the Invention

The present disclosure relates to new and improved methods and apparatus for hybrid microwave horns for transmission of information over send and receive frequencies within the Ka-band separated by a guard band. Near-$HE_{11}$ modes at the horn aperture produce high power gain and low cross-polarization for signals processed within both the send and receive regions of the Ka-band.

2. Brief Description of Related Developments

The Ka-band is used, for example, for transfer of graphics, video, voice, commands, control signals and other data types between a ground station and one or more geostationary satellite. Data is transferred from a ground station over an uplink band within the Ka-band to a satellite. Similarly, data is transferred from a satellite over a downlink band within the Ka-band to the same or another ground station. A horn can be used alone or in combination with a parabolic reflector antenna, or other reflector type, to achieve additional signal gain for the various types of data transferred among earth stations and satellites.

SUMMARY OF THE INVENTION

A new, improved and non-obvious multi-segment microwave horn is disclosed. The horn is designed for operating within a first window of a selected frequency band, for example, the Ka-band, for transmitting information to a communication target. The horn also operates within a second window of a selected frequency of the selected frequency band for receiving information from a communication target. The horn includes a circular throat segment with alternating grooves and webs that have linearly increasing groove widths expanding toward the horn aperture. This segment of the horn provides wide-band impedance matching to the input. A circular middle segment includes an up-angle flare section and a down-angle flare section. Each of the two segments includes dual depth corrugations for optimizing the reception and transmission of information through the horn by generating a near-$HE_{11}$ mode. The final segment of the horn includes a smooth wall conical segment having a minor circumference enclosing an area that matches the area within the circumference of the last groove and a major circumference enclosing an area that matches the area within the circumference of the last web. The area of the major circumference is the horn's aperture. This structure allows the radius of the aperture of the horn to extend to the fullest possible limit in the absence of corrugations and thus provides the maximum possible aperture real estate area.

A new, improved and non-obvious method is also disclosed. The method steps include operating a horn within a first window of a selected frequency band, for example, the Ka-band, for transmitting information to a communication target and within a second window of the selected frequency band for receiving information from a communication target. The method steps further include creating a circular throat segment including alternating grooves and webs having linearly increasing groove widths toward the horn aperture for wide-band impedance matching among adjacent segments of the horn. In the next step, a circular middle segment is created using a dual truncated cone, or frustum, including an up-angle flare section and a down-angle flare section. Each dual depth flare section has dual depth corrugations for optimizing the reception and transmission of information through the horn by generating a near-$HE_{11}$ mode.

The last segment of the horn is made by coupling a smooth-walled, double truncated cone—also referred to as a geometric frustum—to the middle segment 13 of the horn. The minor circumference and area of the smooth-walled frustum is selected to mate with the circumference and area of the last groove "A1" within the middle segment of the horn. The major circumference and area of the smooth-walled frustum is selected to mate with the circumference and area of the last web "B1" within the middle segment of the horn. The smooth-walled frustum or truncated cone allows the radius of the horn aperture to extend to the fullest possible length and area, in the absence of corrugations, to create the maximum possible aperture real estate area.

BRIEF DESCRIPTION OF THE DRAWINGS

FIGS. 4*a* and 4*b* represent a single table that is split between the two figures. The table identifies the radii and width of each numbered groove and web pair A1 and B1, the last groove-web pair within middle segment 14 of the horn, up to the first groove-web pair A49 and B49 within the throat segment 12. The table shows that the grooves and webs alternate throughout the length of the horn.

FIG. 7 is a table listing the increase in power gain achieved by the present, new and improved horn above the power gains of a standard corrugated horn at the frequencies listed in the left-hand column.

DETAILED DESCRIPTION OF THE PREFERRED EMBODIMENT(s)

Figure 1:
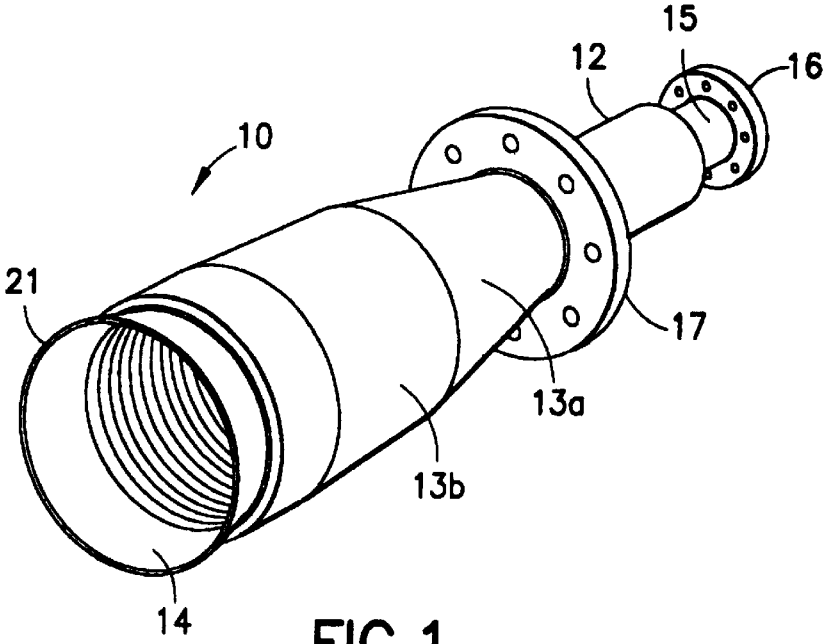
FIG. 1 is a perspective view of an assembled new and improved three-section, circular cross-section, corrugated Ka-band horn with a final conical segment having smooth-walls within the interior of the final segment and a circular aperture area for radiating modulated electro-magnetic energy into space and for receiving electro-magnetic energy from space.

FIG. 1 is a perspective drawing of a fully operational, new and improved Ka-band horn 10 disclosed herein. The horn exhibits high signal gain and low cross-polarization at the aperture of the horn. Horn 10 is designed, for example, to transfer data between a ground station and a geo-stationary satellite within an uplink transmit microwave band or window of from 19.7 GHz through 20.2 GHz (a 500 MHz band) and to receive data over a downlink receive microwave band or window of from 28.3 GHz through 28.6 GHz (a 300 MHz band).

Horn 10 includes multiple, circular cross-section segments including a throat segment 12, a middle segment 13, and a final segment 14. The three horn segments are aligned to a common longitudinal axis through the horn for the passage of traveling electromagnetic waves bi-directionally between, for example, a ground station and an orbiting geostationary satellite.

Figure 2:
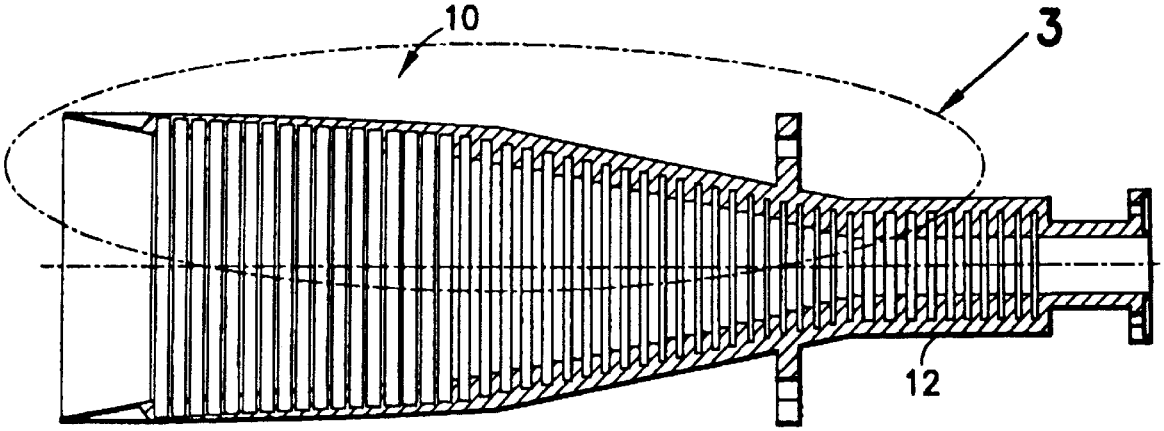
FIG. 2 is a longitudinal cross-sectional view of the circular passage along the central axis through the horn of FIG. 1.

The throat segment 12 includes a set of widening, circular corrugations formed by alternating grooves "A" and webs "B" identified in the table split between FIGS. 4*a* and 4*b* and by distance from aperture 21. The distances of each groove and each web from aperture 21 are provided, for the grooves, in a row within FIG. 2 located above the longitudinal axis 18 of horn 10 and, for the webs, in a row within FIG. 2 located below the longitudinal axis 18 of horn 10.

The pitch of the throat corrugations is linearly increased in the direction of the aperture 21 by linearly increasing the width of each successive groove while keeping the widths of the webs and the radii of the grooves and webs at fixed dimensions. The throat corrugations are selected to favor the passage of frequencies within transmit and receive windows of the Ka-band to provide a good input impedance match.

The middle segment 13 of the horn includes two subsections: respectively, a first up-angle flare section 13*a* including a series of dual-depth, concentric, circular corrugations created by assigning different radii to grooves A and webs B and a second down-angle flare section 13*b* also including a series of dual-depth, concentric, circular corrugations created by assigning different radii to grooves A and webs B. The dual-depth corrugations optimize the performance of the horn within transmit and receive windows within the Ka-band.

The final segment 14 of horn 10 is a smooth-wall, truncated cone having a centerline or axis linearly aligned to the longitudinal axis 18 of horn 10. Final segment 14 includes a minor circumference and area for mating with the circumference and area of the last groove "A1" within horn segment 13. Final segment 14 also includes a major circumference 26 and area that equals the circumference and area of the last web "B1" within the middle segment 13 of horn 10. Therefore, aperture 21 of horn 10 is the major circumference and area of the truncated horn segment 14.

The final smooth-wall segment 14 recovers the entire available aperture real estate lost in the previous segments due to the heights of the corrugated interior walls of those segments.

Specifically, horn 10 provides the signal gains posted in the right most column of the table of FIG. 7 for each of the identified transmit and receive frequencies assigned to horn 10.

Figure 8A:
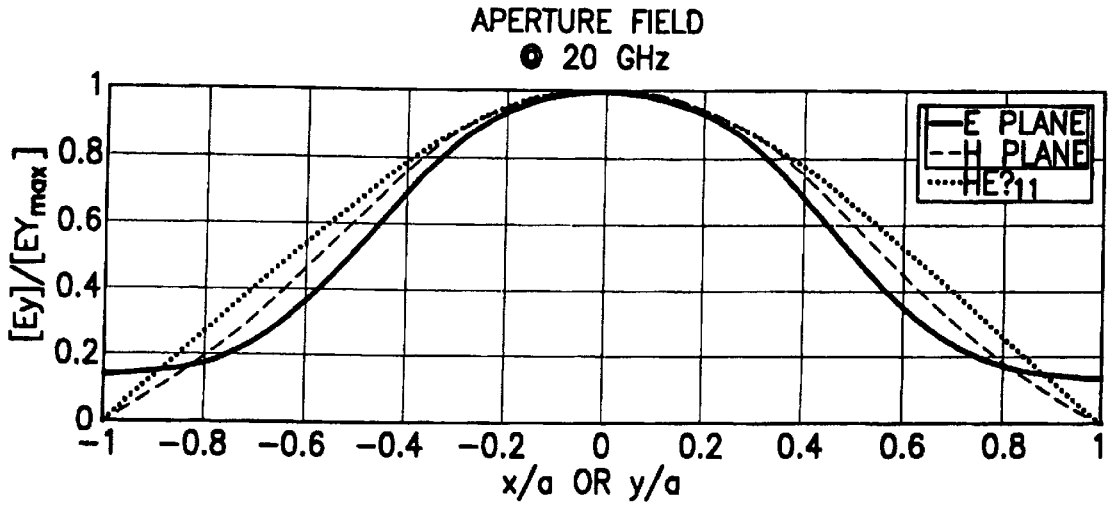
FIG. 8*a* represents the normalized amplitude distributions of the electromagnetic field in the aperture of the horn at 20 GHz.
Figure 8B:
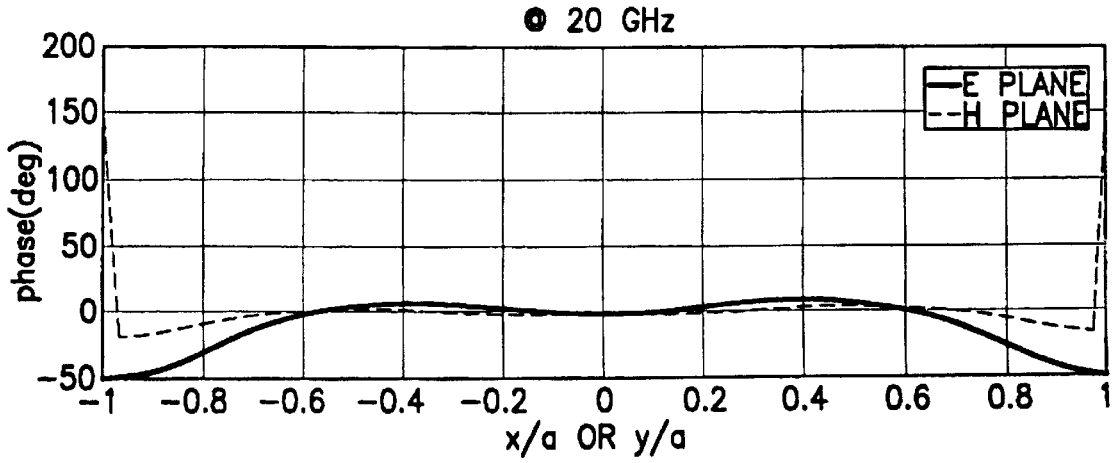
FIG. 8*b* is a graph of the phase of the aperture field of the horn at 20 GHz.
Figure 9:
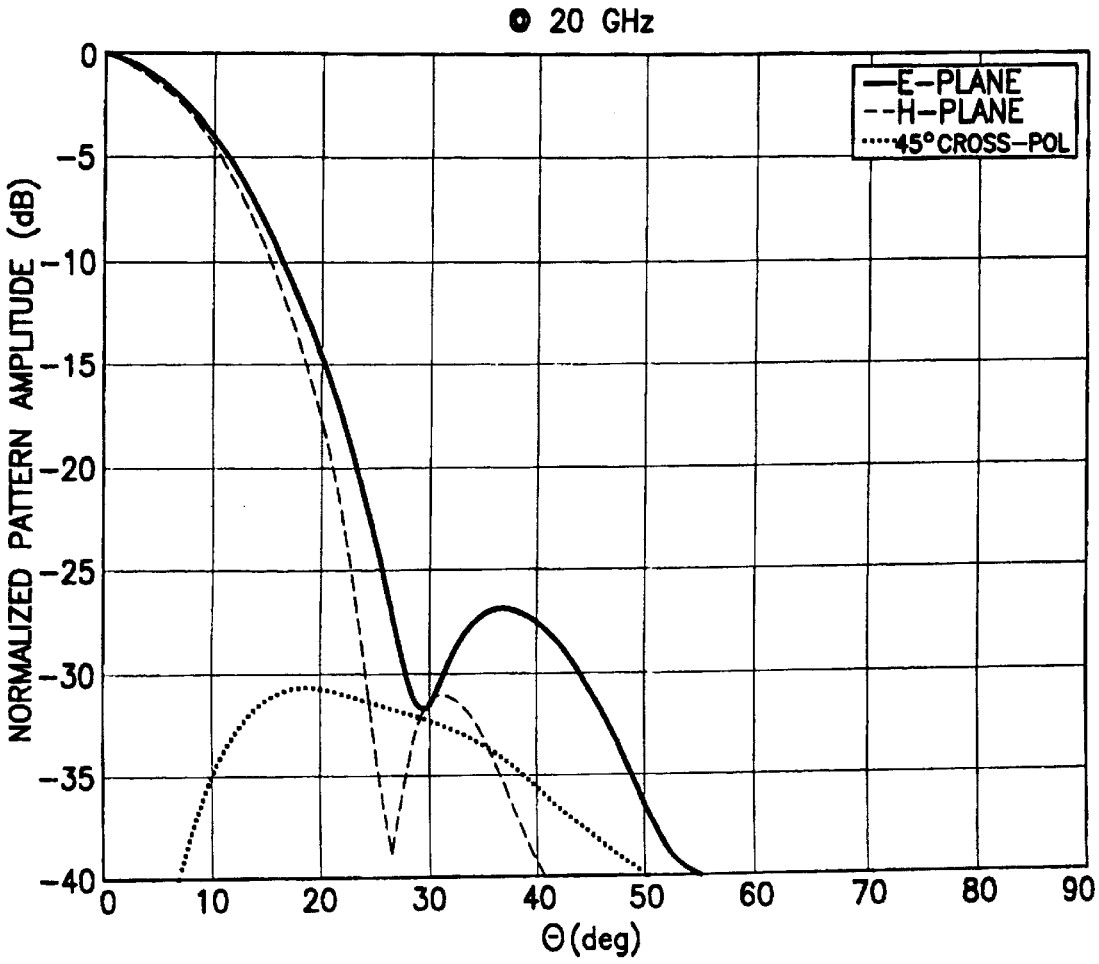
FIG. 9 is a graph of the "normalized pattern amplitude" (dB) at 20 GHz.

Predicted and measured performance of a prototype horn 10 show excellent agreement as represented by the plots of FIGS. 8*a*, 8*b* and 9 for radiation pattern and aperture field obtained by theoretical analysis at the Tx frequency of 20 GHz.

The area within the circumference of a circle is $pi \times r^2$. The circumference of a circle is: $pi \times D = C$ wherein the diameter ("D") of a circle is radius ("r")×2 and the circumference ("C") of a circle is: C=2×("r")×3.141 ("pi"). Therefore, the circumference of the aperture 21 of horn 10 is: C=2×2.549×3.141=16.013 cm. The area within the circumference of the aperture 21 is $2.549^2 \times 3.141\ cm^2 = 20.48\ cm^2$.

Likewise, the minor circumference of truncated horn 14 is: C=2×2.262×3.141=14.210 cm. The area within the circumference 14 is 16.07 $cm^2$.

The smooth-wall segment 14 of horn 10 recovers the lost portion of an aperture of a corrugated horn due to the reduction to the diameter of the horn caused by circular, alternating grooves and webs formed on the inside surfaces of the horn.

Figure 3:
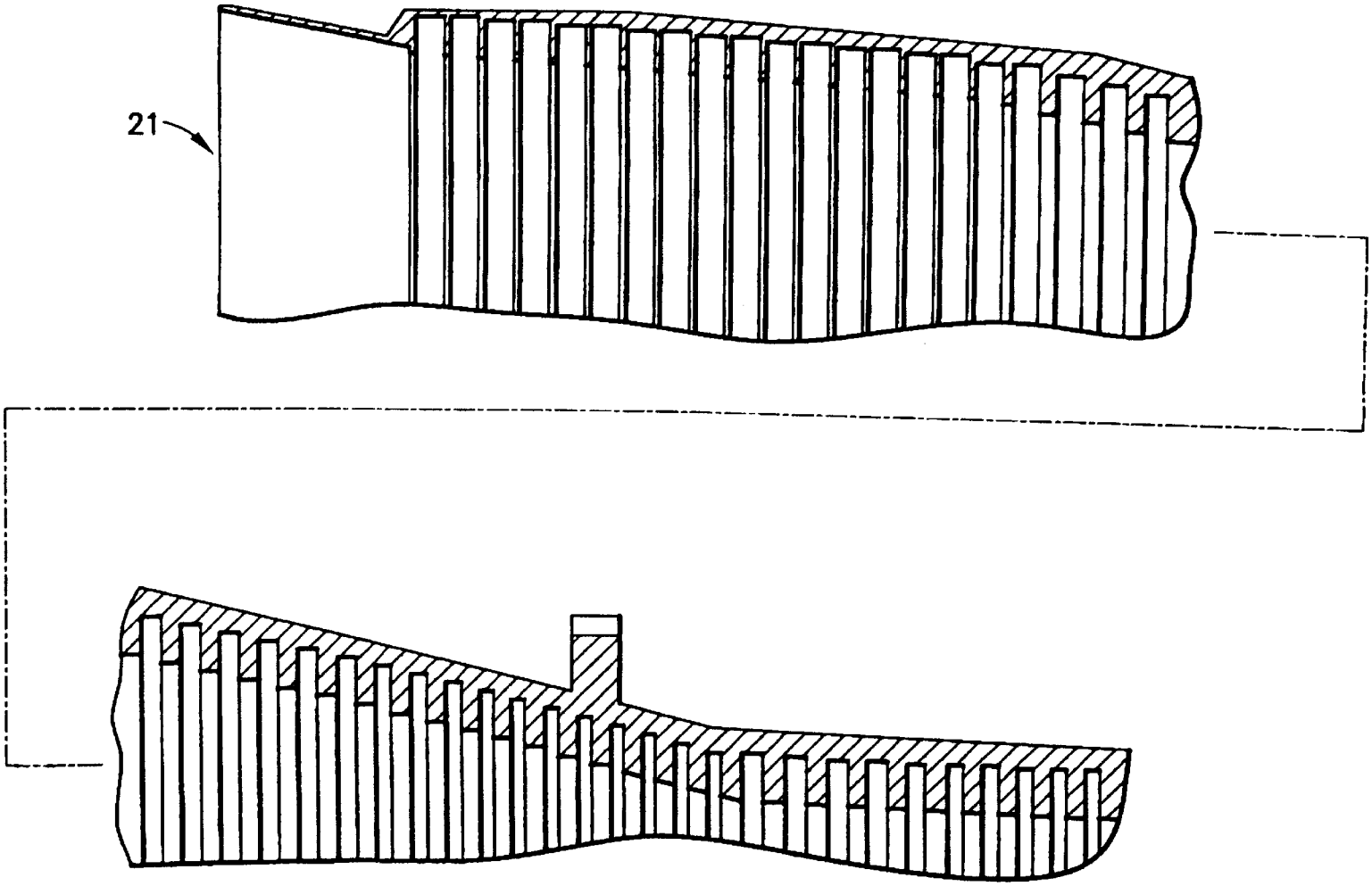
FIG. 3 is an enlarged, partial but substantial longitudinal view of a portion of horn 10 of FIG. 2 identified as within the dashed lines labeled "detail D". This view of the horn illustrates the circular corrugated segments and smooth walled segment of horn 10 that provides high signal gain, low cross-polarization and near $HE_{11}$ mode at the horn aperture.
Figure 5:
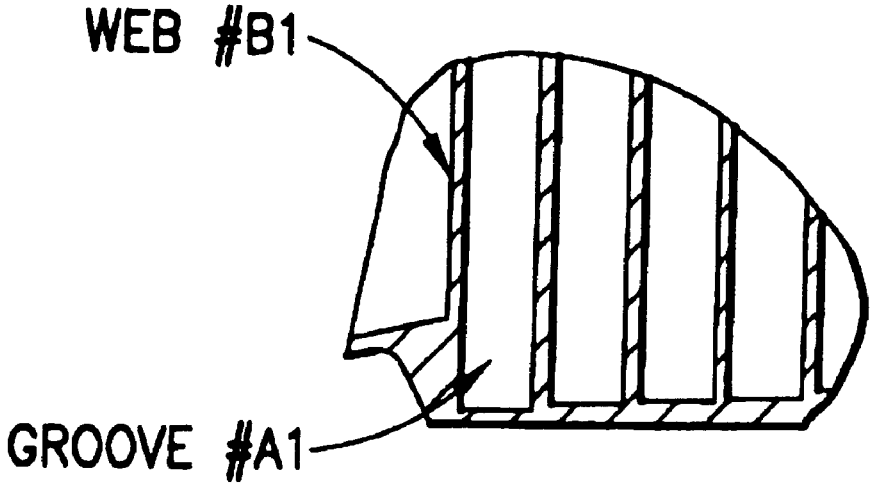
FIG. 5 is an enlarged, partial view of an area of horn 10 identified as "DETAIL E" within FIG. 2. The groove-web pair A1 and B1 has circumferences and areas that are equal to the circumferences and area of the major and minor circumferences of the smooth-wall final segment 14 of horn 10.
Figure 6:
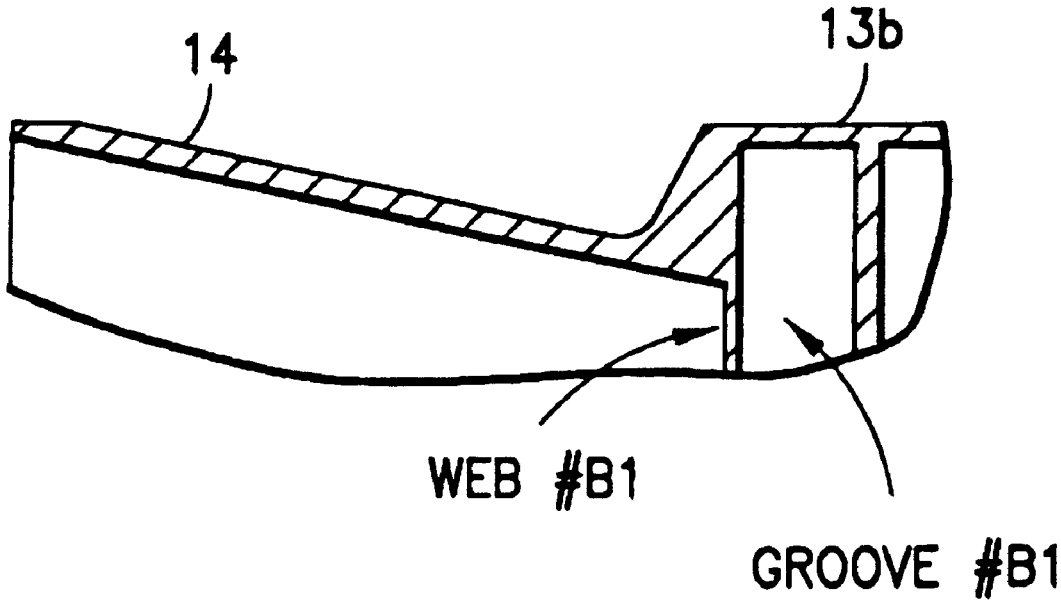
FIG. 6 is an enlarged, partial view of horn 10 of FIG. 3 identified as "DETAIL F" within FIG. 2 that illustrates the up-angle flare of the conical segment 14 of horn 10.

The flare angle of the final section 14 is about 10° relative to the longitudinal axis of horn 10. The flare angle is substantially the same as the flare angle formed along the base of the grooves as identified by their radii in the table of FIGS. 3*a* and 3*b*.

The attitude or length of the truncated cone segment 14 is a critical design parameter that must not degrade the near $HE_{11}$ made at aperture 21 generated by the preceding parts or segments of horn 10. The hybrid modes set up by the corrugated sections radiate out of the larger aperture afforded by the smooth inside-wall circular truncated conical segment 14.

What is claimed is:

1. A hybrid corrugated horn for dual band operation at a selected frequency band wherein a window at one end of the band is provided for transmitting information and a window at a second end of the band is provided for receiving information, the horn comprising the following elements considered in combination with one another:

a throat segment including circular corrugations that increase linearly in pitch for frequency matching within the transmit and receive windows of the selected band and for input impedance match;

a middle segment including two conical sub-sections of dual-depth circular corrugations wherein a first conical sub-section flares up in angle and a second conical sub-section flares down in angle to optimize sending and receiving of information within the transmitting and receiving windows of the selected band; and a final segment including a smooth-wall, truncated circular cone section having a minor circumference and area for mating with the circumference and area of a last groove of the second flared section of the middle segment of the horn and a major circumference and area that matches the circumference and area of a last web within the horn for radiating modulated energy into space and for receiving modulated energy from space to interchange information.

2. The horn of claim 1 wherein a frequency guard band exists between the window at a first end of the selected frequency band and the window at a second end of the selected frequency band.

3. The horn of claim 1, wherein a waveguide feed is coupled to the throat segment of the horn.

4. The horn of claim 1, wherein the circular corrugations of the throat segment of the horn include alternating grooves and webs wherein the radii of the grooves and of the webs are held constant within the throat segment wherein the dual depth circular corrugations are formed by assigning a larger radius to either the grooves or to the webs.

5. The horn of claim 4 wherein a larger fixed radius is assigned to the grooves than is assigned to the webs.

6. The horn of claim 5, wherein the widths of the grooves increase linearly in the direction of the aperture of the horn while the widths of the webs remain a constant dimension that is substantially the same as the largest groove width within the throat segment of the horn.

7. The horn of claim 1, wherein the up-angle flared subsection of the middle segment of the horn is formed by linearly increasing the radii of the grooves and webs, linearly increasing the width of the grooves and continuing the fixed widths of the webs within the throat into the up-angle flared subsection.

8. The horn of claim 7, wherein the down-angle flared subsection of the middle segment of the horn is formed by continuing to linearly expand the radii of the grooves and webs and holding the widths of the grooves to a fixed width dimension nearly five-times the width of the webs.

9. The horn of claim 8, wherein the flare of the final segment continues the flare angle of the down-angle flare section of the middle segment of the horn.

10. A method for transmitting and receiving information with a conical, corrugated horn wherein information is transmitted within a first window at one end of a selected frequency band and wherein information is received within a second window of the selected frequency band, the method comprising:

creating dual depth corrugations within a throat segment of the horn by setting radii of grooves and webs within the throat segment to first and second fixed dimensions;

setting the pitch of the dual depth corrugations within the throat segment by increasing linearly the width of the grooves in the direction of an aperture of the horn and by holding the width of the webs within the throat segment to a fixed dimension for matching transmit signal and receive signal frequencies to the first and second windows of the Ka-band and for matching the impedance of the throat segment to the impedance of a circular wave guide feed;

creating an up-angle, conical flare section within a middle segment of the horn by increasing linearly both the radii of the grooves and webs in the direction of the aperture of the horn wherein the up-angle slope of the grooves is greater than that of the webs;

creating a pitch of the up-angle conical flare section by increasing linearly the widths of the grooves and holding the widths of the webs to a fixed width dimension;

creating a down-angle, conical flare section within the middle segment of the horn by continuing to increase linearly the radii of the grooves and webs in the direction of the aperture of the horn at radii dimensions that are larger than those within the up-angle conical flare section and by holding the widths of the grooves and webs to fixed dimensions wherein the widths of the webs are multiple times smaller than the widths of the grooves; and adding a final smooth-wall, truncated cone segment to the middle segment of the horn, the final segment including a minor circumference and area for mating with the circumference of the down-angle portion of the middle segment of the horn and a major circumference and area comprising the horn aperture for radiating modulated energy into space and for receiving modulated energy from space.

11. The method of claim 10, wherein the major circumference and area of the final segment is substantially the same as a circumference and area of the last web within the middle segment of the horn.

12. The method of claim 10 further including making circular corrugations within the horn by making the radii of the grooves larger than the radii of the webs.

13. The method of claim 10 further including making circular corrugations within the horn by making the radii of the webs larger than the radii of the grooves.

14. The method of claim 10 further including using a guard band within the Ka-band located between the send and receive window portions of the Ka-band.

15. The method of claim 10 further including coupling a waveguide feed to the throat segment of the horn.

16. A multi-segment microwave horn for operating within a first window of a selected frequency band for transmitting information to a communication target and a second window within the selected frequency band, separated by a guard band from the first band, for receiving information from a communication target, the horn comprising the following elements considered in combination with one another:

a circular throat segment including alternating grooves and webs having linearly increasing groove widths toward a horn aperture for wide-band impedance matching among adjacent segments;

a circular middle segment including an up-angle flare section and a down-angle flare section each having dual depth corrugations for optimizing the reception and transmission of information through the horn including creating a near-$HE_{11}$ mode; and a final segment including a truncated section having a minor circumference and area that matches a circumference and area of a last groove of the dual depth corrugations and a major circumference that matches a circumference and area of a last web of the dual depth corrugations and that defines the horn aperture such that the final segment recovers aperture area lost due to the dual depth corrugations.

17. A method for operating a horn within a first window of a selected frequency range for transmitting information to a communication target and a second window within a selected frequency range, separated by a guard band from the first band, for receiving information from a communication target, the method comprising:

creating a circular throat segment including alternating grooves and webs having linearly increasing groove widths toward a horn aperture for wide-band impedance matching among adjacent segments;

creating a circular middle segment including an up-angle flare section and a down-angle flare section each having dual depth corrugations for optimizing the reception and transmission of information through the horn including creating a near-$HE_{11}$ mode; and creating a final segment including a truncated section having a minor circumference and area that matches the circumference and area of a last groove of the dual depth corrugations and a major circumference and area that matches the circumference and area of a last web of the dial depth corrugations and defining the horn aperture such that the final segment recovers aperture area lost due to the dual depth corrugations.

* * * * *